US005364107A

United States Patent [19]

Kinkead

[11] Patent Number: 5,364,107

[45] Date of Patent: Nov. 15, 1994

[54] SIMULATED LIE DETECTOR APPARATUS

[76] Inventor: Farrell G. Kinkead, 3203 Squireswood, Carrolton, Tex. 75006

[21] Appl. No.: 112,346

[22] Filed: Aug. 27, 1993

[51] Int. Cl.[5] ..... A63F 9/00

[52] U.S. Cl. ..... 273/430; 273/460

[58] Field of Search ..... 273/460, 433, 430, 237, 273/85 G; 446/397, 408

[56] References Cited

U.S. PATENT DOCUMENTS

| | | | |
|---|---|---|---|
| 3,648,686 | 3/1972 | Payne | 273/460 |
| 3,841,316 | 10/1974 | Meyer | 273/460 |
| 4,300,763 | 11/1981 | Barr | 273/460 |
| 4,358,118 | 11/1982 | Plapp | 273/460 |
| 4,961,575 | 10/1990 | Perry | 273/460 |
| 5,032,099 | 7/1991 | Chan | 446/408 |
| 5,209,494 | 5/1993 | Spector | 273/460 |

*Primary Examiner*—Jessica J. Harrison
*Attorney, Agent, or Firm*—John E. Vandigriff

[57] ABSTRACT

The invention is to a game lie detector that is not actuated by direct contact with the person being question, but by a party coordinator that actuates the lie detector arbitrarily and independent of the truthfulness of the answer to the question. A detector box includes a pad upon which the person being questioned places a hand. The detector box includes a receiver and out put devices that are actuated from signals from a remote control device concealed on the person who is the game coordinator.

15 Claims, 3 Drawing Sheets

SIMULATED LIE DETECTOR APPARATUS

FIELD OF THE INVENTION

The invention is to an apparatus that may be used as a party game that gives an audible and visual indication if a person is telling the truth, and more particularly to an apparatus under the clandestine control of a person who arbitrarily determines if a game player is answering truthfully to a question.

BACKGROUND OF THE INVENTION

Lie detector has been used as party games, but in these instances the resulting decision if the answer is the truth or not depends to some extend on the person answering the question. In U.S. Pat. No. 3,841,316, a circuit is attached to the person answering the question which measures an apparent decrease in skin resistance of a human being in response to stress. The "lie Detector" of this patent may be used and sold as part of a toy "lie detector". However, the decision of whether the person is lying is based upon a galvanic reaction.

In U.S. Pat. No. 3,648,686, an audio signal is emitted in response to the galvanic skin response of the person being questioned.

Both of the above lie detectors depend upon an electrical connection to the person being questioned.

The use of radio signals is disclosed in U.S. Pat. No. 4,961,575. Radio signal senders and receivers are used in an enhanced hide-and-seek game.

SUMMARY OF THE INVENTION

The invention is to an apparatus that may be used at parties to mislead a person that believes they are being tested as to their truthfulness by a lie detector. The apparatus actually does not test any stress or other factor in relation to whether the person is telling the truth or not.

A "detector" apparatus includes a receiver that receives a radio signal to trigger either audio or visual indicators, or both. A person to be questioned, places a hand on top of the apparatus in a designated area. The person is then asked a question. In response to the answer, a response is output from the detector. The response is under the control of a person which may or may not be the person asking the question. The response is manually triggered remotely by a small transmitter in the pocket or otherwise concealed on a person. The person having the transmitter arbitrarily triggers a response regardless whether the answer is the truth or not. The triggering of the lie detector indicating an lie, when the answer is the truth often causes hilarity among the participants.

The remote transmitter may also be triggered by a micro switch concealed, for example, in a shoe, the switch being actuated by the movement of a toe. The principal intent is not to let the participants of the game to know that the indication of truthfulness or not is arbitrarily controlled.

A false remote device may also be used with the detector apparatus. The remote device has the appearance of having a radio link with the detector apparatus, but in fact has no active circuits or connection with the detector apparatus.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
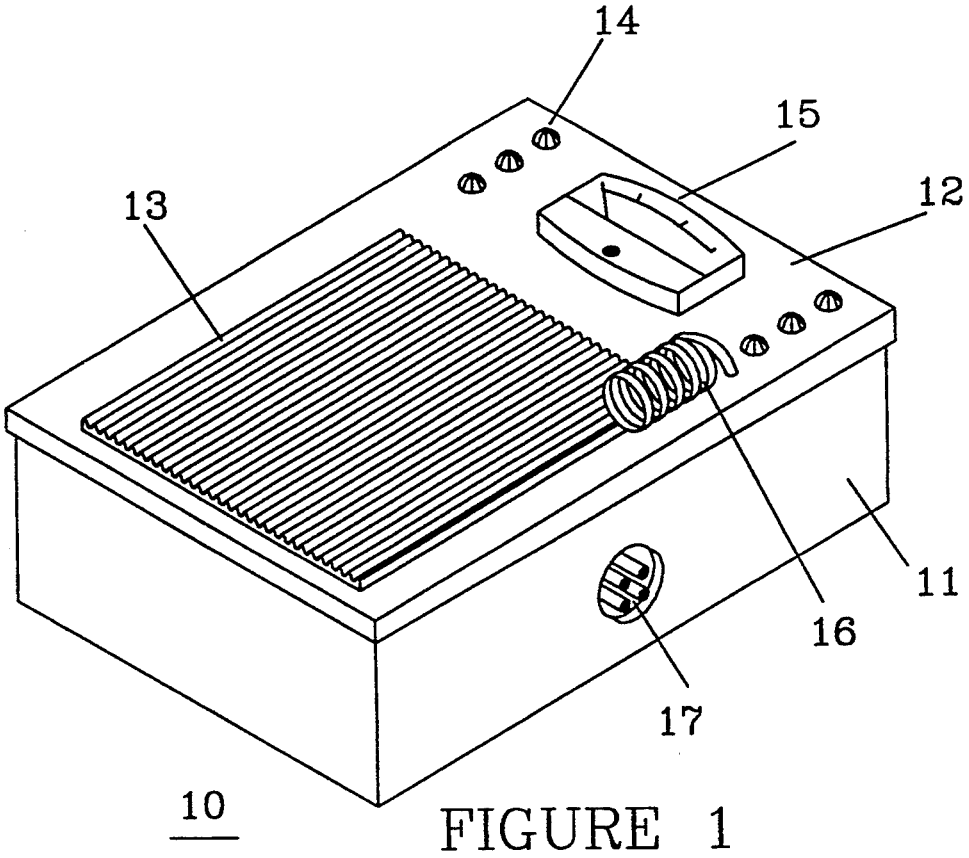
FIG. 1 illustrates the detector apparatus of the present invention.

FIG. 1 illustrates the detector apparatus according to the present invention. Detector 10 has a housing consisting of a base unit 11 and a top cover 12. Cover 12 has a textured pad 13 on which the person who is to be questioned places a hand. In practice, the utility of pad 13 is to provide an area upon which to place the hand. Pad 13 has no other utility in operation of the apparatus. Also on cover 12 is a meter 15, a plurality of indicator lights 14, and an antenna coil 16. Lights 14 and meter 15 provide a visual indication when the answer to the question is indicated as a lie. Meter 15 will provide a reading of an arbitrary lever, and lights 14 will be turned on to a high intensity, or will flash.

Antenna coil 16 appears to attach detector pad 13 to the detector box, but is actually connected to a receiver (FIG. 4) to receive one or more signals that activate lights 14 and meter 15. Also activated is a speaker (FIG. 4) inside housing 11, that emits a piercing audio tone when the answer to a question is indicated to be a lie.

Lie detector 10 is powered by an internal battery, or may be connected to a power source via connector 17 in housing 11.

Figure 2:
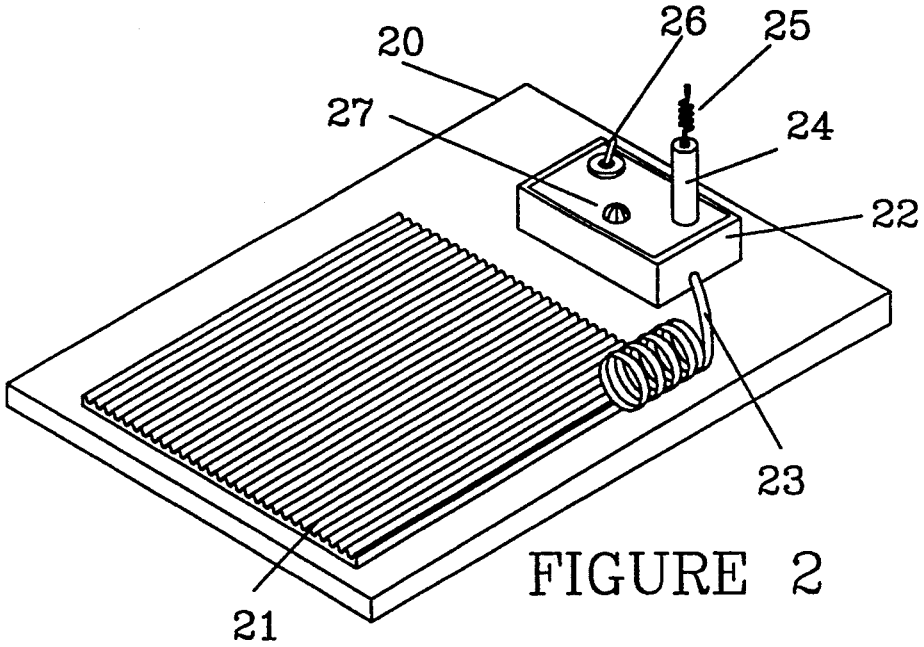
FIG. 2 shows a false remote unit.

FIG. 2 is a false remote detector that may be used in conjunction with the detector in FIG. 1. At a large party, there may be too many participants in the game to gather around the principle detector illustrated in FIG. 1. One or more false remote units may be used to play the game. Remote unit has a base 20 with a pad 21 mounted thereon. A control box has a switch 26, an indicator light 27 and an antenna mount 24 with an antenna coil 25 mounted thereon. A coil 23 appears to attach the detector pad 21 to control box 22. Control box 22 only function is to provide an indicator light so that it appears that the remote unit is activated, and in communication with the detector 10.

Figure 3:
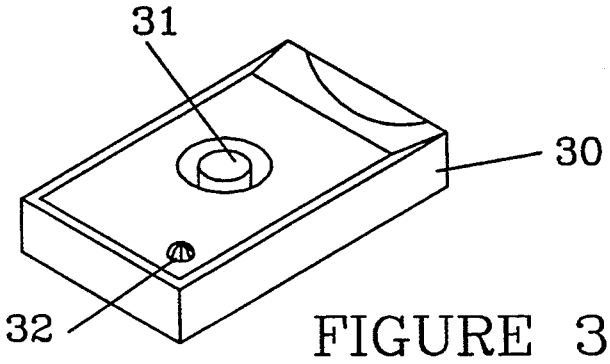
FIG. 3 shows a device for triggering an audio and visual indication on the detector apparatus.

FIG. 3 illustrates one form of remote control triggering device that is concealed on the detector operator. Remote 30 includes a transmitter that is actuated by a push button 31. An optional light 32 may be included. The transmitter may transmit a simple signal that provides a switching action to actuate meter lights 14 or a single tone from a speaker internal to detector housing 10. Alternatively, a coded signal may be sent to actuate a digital produced voice, or words.

Figure 4:
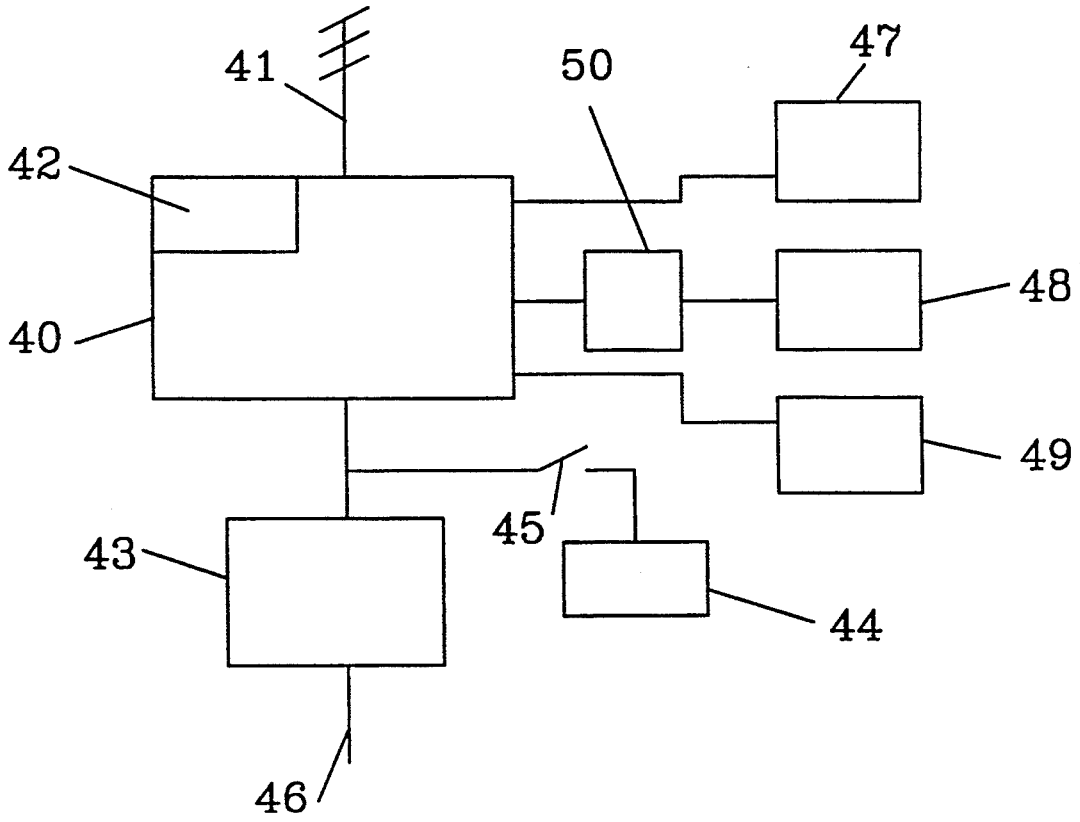
FIG. 4 is a diagram showing the circuit parts used to control the detector apparatus.

FIG. 4 illustrates a block diagram of the circuitry of the detector. A receiver 40 is attached to antenna 41 which receives signals from a remote control such as the remote illustrated in FIG. 3. Receiver 40 may have a decoder 42 built in so that each receiver for different lie detectors may have a different transmitting code which activates the detector circuitry. Receiver 40 is powered either by a power supply 43, having a power input at 46, or may be battery powered by a battery 44 which is mounted in housing 11. Battery 44 may also be charged by power supply 43. Switch 45 is used to apply power to the receiver 40 when battery 44 is used.

Connected to receiver 40 is meter 47, which indicates a reading or output from the receiver. Lights 49, corresponding to indicator lights 15, FIG. 1, are turned on when receiver 40 receives a signal from remote 30, FIG. 3.

Speaker 48 may be connected to receiver 40, or may be connected through a digitally programmed speech module. When speaker 48 is directly connected to receiver 40, an audio tone is emitted when receiver 40 receives a signal from remote 30. When speaker 48 is connected through digital speech module 50, the speaker enunciates a programed word or phrase, such as, "Your Lying", or a similar phrase to indicate that the player is not telling the truth, or the person controlling the remote wants to indicate that the answer is not the truth.

In using the Party Lie Detector 10, a person is asked to place a hand on detector pad 13, and a question is asked of the person. After the person has answered the question, a person who is the game coordinator presses the remote sending a signal to the receiver in the detector, activating the audio and visual indicator. The activation of the indicators is not necessarily indication of the truth of the answer. The activation of the audio and visual indicators indicates that the answer is not the truth. The person who is asked the question does not know that the apparatus is not a real lie detector. A truthful answer may be indicated to not be the truth, depending upon the whim of the game coordinator who has the concealed remote device that activates the detector audio and visual indicators.

What is claimed:

1. A simulated lie detector apparatus for indicating the truthfulness of an answer asked of a player, comprising:

a detector housing;

a pad on the surface of said housing for receiving a player's hand;

a radio receiver inside said housing for receiving a signal;

an audio amplifier and speaker connected to an output of said receiver for producing an audio signal, indicative of the truthfulness of question asked a player, upon receipt of a signal transmitted to said radio receiver; and a small remote transmitter, capable of being hidden on a person for transmitting a signal to said radio receiver to indicate the answer from the player in response to a question is not true regardless whether the answer to the question is the truth or not.

2. The simulated lie detector according to claim 1, including a visual indicator, and a connection to said receiver to actuate the visual indicator when the remote transmitter sends a signal to the radio receiver.

3. The simulated lie detector according to claim 1, including a code circuit in said transmitter and a decode circuit in said receiver so that only signals transmitted from a remote transmitter having the same coding as the receiver will actuate the outputs of the receiver.

4. The simulated lie detector according to claim 1, including a coil wire connected between the pad on the surface of said housing and the inside of the housing which serves as an antenna for the receiver.

5. The simulated lie detector according to claim 1, in combination with a simulated remote lie detector unit, including:

a base with a hand pad thereon on which a player places a hand; and a control box which includes an antenna, switch and light indicator which gives the appearance that the simulated remote unit is electronically connected with the simulated lie detector.

6. The simulated lie detector according to claim 5, wherein said control box includes a battery that powers the light indicator when the switch is in the ON position.

7. A simulated lie detector apparatus for indicating the truthfulness of an answer asked of a player, comprising:

a detector housing; a pad on the surface of said housing for receiving a player's hand;

a radio receiver inside said housing for receiving a signal;

an audio amplifier and speaker connected to an output of said receiver for producing an audio signal, indicative of the truthfulness of question asked a player, upon receipt of a signal transmitted to said radio receiver; and a visual signal indicator; and a small remote transmitter, capable of being hidden in clothing of a person for transmitting a signal to said radio receiver to indicate the answer from the player in response to a question is not true regardless whether the answer to the question is the truth or not.

8. The simulated lie detector according to claim 7, including a first audio output indicating the answer is the truth, and a second audio output indicating the answer is not the truth.

9. The simulated lie detector according to claim 7, including a code circuit in said transmitter and a decode circuit in said receiver so that only signals transmitted from a remote transmitter having the same coding as the receiver will actuate the outputs of the receiver.

10. The simulated lie detector according to claim 7, including a coil wire connected between the pad on the surface of said housing and the inside of the housing which serves as an antenna for the receiver.

11. The simulated lie detector according to claim 1, in combination with a simulated remote lie detector unit, including:

a base with a hand pad thereon on which a player places a hand; and a control box which includes an antenna, switch and light indicator which gives the appearance that the simulated remote unit is electronically connected with the simulated lie detector.

12. The simulated lie detector according to claim 11, wherein said control box includes a battery that powers the light indicator when the switch is in the ON position.

13. A method of playing a game with a simulated lie detector apparatus, comprising the steps of:

having a person place a hand on a pad on a simulated lie detector device;

asking the person a question; and having a game coordinator actuate an indicator on said simulated lie detector to indicate whether the answer to the question given by the person is the truth or not the truth, independent of the truthfulness of the answer.

14. The method according to claim 13, wherein the step of actuating an indicator on the party lie detector is accomplished by a remote device concealed on the person of the game coordinator.

15. The method according to claim 13, including the steps of actuating a first signal representative of a truthful answer, and actuating a second signal representative of an untruthful answer.

* * * * *